US007770993B2

(12) United States Patent
Yamakado

(10) Patent No.: US 7,770,993 B2
(45) Date of Patent: Aug. 10, 2010

(54) PRINTING DEVICE AND PRINT IMAGE PROCESSING DEVICE

(75) Inventor: Hitoshi Yamakado, Hino (JP)

(73) Assignee: Seiko Epson Corporation (JP)

( * ) Notice: Subject to any disclaimer, the term of this patent is extended or adjusted under 35 U.S.C. 154(b) by 465 days.

(21) Appl. No.: 11/284,177

(22) Filed: Nov. 21, 2005

(65) Prior Publication Data

US 2006/0125852 A1 Jun. 15, 2006

(30) Foreign Application Priority Data

Dec. 10, 2004 (JP) ..... 2004-357719

(51) Int. Cl.
*B41J 2/21* (2006.01)

(52) U.S. Cl. ..... 347/15; 347/5; 347/19

(58) Field of Classification Search ..... 347/5, 347/9, 12, 19, 15; 358/1.9
See application file for complete search history.

(56) References Cited

U.S. PATENT DOCUMENTS 6,283,571 B1 * 9/2001 Zhou et al. ..... 347/15
6,352,329 B1 3/2002 Watanabe et al.
2004/0119766 A1 6/2004 Shibata et al.
2005/0062989 A1 * 3/2005 Sakai et al. ..... 358/1.9

FOREIGN PATENT DOCUMENTS

| | | |
|---|---|---|
| JP | 11-268258 | 10/1999 |
| JP | 11-334051 | 12/1999 |
| JP | 2001-024890 | 1/2001 |
| JP | 2001-113805 | 4/2001 |
| JP | 2004-058282 | 2/2004 |
| JP | 2004-058283 | 2/2004 |
| JP | 2004-058284 | 2/2004 |

* cited by examiner

*Primary Examiner*—Lam S Nguyen
(74) *Attorney, Agent, or Firm*—Harness, Dickey & Pierce, P.L.C.

(57) ABSTRACT

A printing device includes a print head having a plurality of nozzles capable of ejecting ink on a print medium and of forming one or more types of ink dots on the print medium; an ink dot setting unit that determines an ink dot setting for each pixel of image data by comparing a gradient of the each pixel with, from among thresholds in a matrix for each of respective pixels, a threshold corresponding to the each pixel of image data; a print head controller that controls ejection of ink from each nozzle of the print head on the basis of an ink dot setting determined by the ink dot setting controller; and a threshold matrix correction unit that corrects a predetermined threshold of the matrix depending on ink output characteristics of each nozzle of the print head.

5 Claims, 8 Drawing Sheets

FIG. 10A

| | | | | | |
|---|---|---|---|---|---|
| 44 | 145 | 23 | 187 | 12 | |
| 243 | 136 | 88 | 23 | 205 | |
| 18 | 79 | 179 | 64 | 40 | |
| 149 | 21 | 56 | 217 | 138 | |
| 210 | 159 | 13 | 189 | 27 | |
| | | | | | |

LIGHT BAND APPEARING (-30)

FIG. 10B

| | | | | | |
|---|---|---|---|---|---|
| 44 | **115** | **0** | 187 | 12 | |
| 243 | **106** | **58** | 23 | 205 | |
| 18 | **49** | **149** | 64 | 40 | |
| 149 | **0** | **26** | 217 | 138 | |
| 210 | **129** | **0** | 189 | 27 | |
| | | | | | |

DARK BAND APPEARING (+30)

FIG. 10C

| | | | | | |
|---|---|---|---|---|---|
| 44 | **175** | **53** | 187 | 12 | |
| 243 | **166** | **118** | 23 | 205 | |
| 18 | **109** | **209** | 64 | 40 | |
| 149 | **51** | **86** | 217 | 138 | |
| 210 | **189** | **43** | 189 | 27 | |
| | | | | | |

PRINTING DEVICE AND PRINT IMAGE PROCESSING DEVICE

The entire disclosure of Japanese Patent Application No. 2004-357719, filed on Dec. 10, 2004, is expressly incorporated by reference herein.

BACKGROUND

1. Technical Field

The present invention relates to a printer device which converts image data to print data, and prints the print data onto print media, and also relates to an associated print image-processing device. The invention is suitable for use for an inkjet printer which ejects fine particles (i.e., dots) of ink with different colors onto print media (a recording medium) to thereby form characters and images.

2. Related Art

Along with the proliferation of personal computers and digital cameras, inkjet printers are now widely used not only in offices but also by personal users, since they are generally capable of performing high quality color printing at low cost.

An inkjet printer of one type forms desired characters or images on print media by causing an object, commonly a carriage, which has integrated therein an ink cartridge and a print head, to reciprocate transversely relative to a paper feeding direction, while ejecting (i.e. spraying) particles of liquid ink in dots from nozzles provided on the print head. In addition to monochrome printing, full-color printing can also be readily performed if a printer carriage is provided with ink cartridges for the colors Yellow, Magenta, and Cyan, in addition to Black, with print heads being provided for each of the respective colors. Ink cartridges having six, seven, or even eight ink colors including, for example, Light Cyan and Light Magenta, and so on, in addition to the above four colors are now also commercially available.

The type of inkjet printer described above, however, suffers from a drawback in that a time taken for it to complete a print job is considerably longer as compared to that taken by some other types of printers, such as a laser printer employing electrophotography, which is used in a photocopier. The slow print time of the described carriage-type inkjet printer is due to a large number of reciprocal movements of a print head of the carriage of the printer in a direction transverse to a paper feeding direction of the printer that are required to be made to achieve fine printing. Thus, for fine printing of a single sheet of a print medium, several tens to possibly more than one hundred reciprocal passes in a direction transverse to a paper feeding direction may be required.

There is also known in the art another type of inkjet printer, which does not have a carriage and rather is provided with a print head having a long length capable of traversing a medium to be printed on. In this type of inkjet printer, since there is no need to move a print head in a width-wise direction of a print medium, printing of a print image requires only a single pass of the print head; and therefore printing can be performed at a high speed, similar to that of a laser printer. The former described inkjet printer having a carriage is generally referred to as "a multi-pass printer"; and the latter type is generally referred to as "a line head printer." In a multi-pass printer, a nozzle-mounted nozzle head is caused to move or scan, for example, in a width-wise direction of a print medium and the print medium itself is also caused to move or scan, for example, in its longitudinal direction. In a line head printer, the print medium only is caused to move or scan in, for example, its longitudinal direction.

In each type of inkjet printer described above, a print head is an indispensable element, and is configured to have a series of microscopic nozzles disposed at set intervals in multiple rows, with each of the nozzles having a diameter of generally between 10-70 micrometers. However, a direction of ejection of ink from the nozzles may be subject to some variation, or skew, due to tilting or misalignment of nozzles arising during the manufacturing process. As a result of such skew, dots of ink ejected from the nozzles may deviate from a target position, giving rise to so-called "splash bending".

As a result of splash bending and deviation in proper distance between nozzles, printing in an area corresponding to that of such defective nozzles may be subject to so-called "banding", which can result in considerable degradation in print quality. Such "banding" may manifest on a print medium as either light or dark banding; with light banding appearing when ink dots are formed on a light print medium and distances between neighboring dots are excessively long; and dark banding appearing when such distances are excessively short.

Banding, when it occurs, is far more pronounced when occurring with use of a line head printer as compared to a multi-pass printer. The reason for this is that a line head printer has a print head provided in a fixed position for effecting single pass printing, and also has a considerably larger number of nozzles than are provided in a print head (s) of a multi-pass printer. It is to be noted here, however, that in using a multi-pass printer it is possible to make light banding less noticeable by taking advantage of repeated reciprocal print head movement.

To reduce banding in printing, a software approach referred to as "print control" has been suggested in addition to the hardware approach outlined above.

For example, in the techniques proposed in JP-A-2001-113805, a gradient of each pixel of image data is compared to a threshold, corresponding to each pixel of the image data matrix. In controlling a setting of an ink dot for each pixel, thresholds within the matrix are set depending on print information which is obtained as a result of carrying out a reference print operation using a nozzle head, i.e., a nozzle output characteristic. More specifically, where a line is a column orthogonal to a scanning direction of a print medium, 1) an average resolution is obtained for each respective line of actual print image data; 2) when a dot is formed in a particular cell of a matrix, potentials for other cells of the matrix are obtained based on the average resolution for each line; and 3) when a dot is formed in a cell of the matrix having the smallest potential, potentials for other cells of the matrix are then obtained. These processes are repeated in a set order until dots are formed in each respective cell of the matrix. In the techniques proposed in JP-A-2004-58282, JP-A-2004-58283, and JP-A-2004-58284, a matrix is generated which corresponds to respective pixels of image data, and an effect on a neighboring matrix resulting from formation of an ink dot in a matrix corresponding to a particular pixel is obtained from data of a reference print operation. Consequently, an ink output instruction for each nozzle of a nozzle head can be corrected based on a determination of such an effect.

However, it is difficult to put into practical use the print image processing techniques proposed in the above patent application documents since the above print image processing techniques require a large number of computations. That is, a large number of programs needs to be written; a large number of computations and a large storage capacity are also required. The proposed techniques are also disadvantageous in terms of cost and energy consumption.

SUMMARY

An advantage of some aspects of the invention is to provide a printer device and a print image processing device that are capable of readily reducing banding in a line head printer, and which are well-suited for practical application.

According to a first aspect of the invention, a printing device comprises: a print head having a plurality of nozzles capable of ejecting ink on a print medium and of forming one or more types of ink dots on the print medium; an ink dot setting unit that determines an ink dot setting for each pixel of image data by comparing a gradient of the each pixel with, from among thresholds in a matrix for each of respective pixels, a threshold corresponding to the each pixel of image data; a print head controller that controls ejection of ink from each nozzle of the print head on the basis of an ink dot setting determined by the ink dot setting controller; and a threshold matrix correction unit that corrects a predetermined threshold of the matrix depending on ink output characteristics of each nozzle of the print head.

In this case, the process of determining an ink dot setting for a corresponding pixel is referred to as a binalization process or N-quantify process. This process, which will be described later in more detail, is a process of categorizing each of a respective pixel of image data of multilevel values (e.g., 8 bits, 256 tones) into binary (or N-level) values on the basis of a threshold value. The process is used both in determining whether an ink dot should be ejected and in changing a size of an ink dot for ejection depending on pixel gradation. Thus, the process is used for realizing so-called halftones which cannot be realized simply by ejecting or not ejecting an ink dot. Further, predetermined thresholds of a matrix are determined, for example, in a dither matrix method. Still further, an ink dot means a micro particle of a liquid ink ejected from a nozzle. As an ink dot becomes larger, a density becomes higher (larger in quantity) in a range consisting of a plurality of dots; and as an ink dot becomes smaller, a density becomes lower (smaller in quantity).

In the printer device according to the first aspect of the invention, a gradient of each pixel constituting image data is compared with a threshold of a matrix also corresponding to each pixel of the image data to determine an ink dot setting, whereby banding is minimized. Upon controlling ink ejection from each nozzle of a head on the basis of an ink dot setting, predetermined matrix thresholds are corrected for each nozzle of the head on the basis of ink output characteristics obtained from data of a reference print operation. In this way, matrix threshold correction can be readily carried out either in a case where a distance between ink dots formed by adjacent nozzles is larger than a predetermined value, or where a distance between ink dots formed by adjacent nozzles is smaller than a predetermined value. In the former case, probability of ejection of an ink dot can be increased, or a size of an ejected ink dot can be increased; and in the latter case, probability of ejection of an ink dot can be decreased; or a size of an ejected ink dot can be reduced.

As mentioned, banding can manifest as either light or dark banding on a print medium. One factor that influences the occurrence of banding is so-called "splash bending", which results not from lack of ink ejection from ink jet nozzles but rather due to a discrepancy in a direction of ejection of ink from ink jet nozzles due to tilting of the nozzles or the like, thereby resulting in deviation of an actual landing position of ejected ink from a target position. So-called light banding occurs where distance between adjacent ejected ink dots is larger than a predetermined distance and a density of ink becomes smaller; while so-called dark banding occurs where repeated misalignment of ejected ink dots occurs or a distance between adjacent ejected ink dots is smaller than predetermined interval and a density of ink becomes larger. Dark banding can also occur where a part of an ink dot that deviates from its target print position partially overlaps with a properly aligned printed ink dot.

It is preferable that the threshold matrix correction unit, in a case that a space between ink dots formed by adjacent nozzles is larger than the predetermined value, may correct a threshold in the matrix such that a probability of an ink dot being formed for the subject pixel is increased, or a size of an ink dot formed for the subject pixel is increased.

In the printer device, light banding, in particular, can be minimized since a matrix threshold is corrected such that, in a case where an amount of space between ink dots formed by adjacent nozzles is larger than a predetermined value, either a probability of subsequent ejection of an ink dot is increased, or a size of a subsequently ejected ink dot is increased.

It is preferable that the threshold matrix correction unit, in a case that an amount of space between ink dots formed by adjacent nozzles is smaller than the predetermined value, may correct a threshold in the matrix such that a probability of an ink dot being formed for the subject pixel is decreased, or a size of an ink dot to be formed for the subject pixel is decreased.

In the printer device, dark banding, in particular can be minimized since a matrix threshold is corrected such that, in a case where a space between ink dots formed by adjacent nozzles is smaller than a predetermined value, either a probability of subsequent ejection of an ink dot is decreased, or a size of a subsequently ejected ink dot is decreased.

It is preferable that the threshold matrix correction unit may use, as the ink output characteristic, a quantity of splash bending showing an amount of deviation from an ideal ink dot position from each nozzle of the head, to determine the amount of space between ink dots formed by the adjacent nozzles based on a quantity of splash bending.

In the printer device, spacing between ink dots to be formed by adjacent nozzles is based on a quantity of splash bending, thereby making it possible to readily and effectively reduce both light and dark banding.

According to a second aspect of the invention, a print image processing device, comprises an ink dot setting controller that determines an ink dot setting for each pixel of image data by comparing a gradient of the each pixel, from among thresholds in a matrix for each respective pixel, with a threshold corresponding to each pixel; and a threshold matrix correction unit that corrects a threshold of the matrix depending on ink output characteristics of each nozzle of a nozzle head of a printer device, the correction including, in a case that a space between ink dots formed by adjacent nozzles is larger than a predetermined value, correcting the threshold so that a probability of an ink dot being formed for pixels corresponding to the adjacent nozzles is increased, or a size of an ink dot to be formed for the pixels is increased.

In the print image processing device according to the second aspect of the invention, a gradient of each pixel of image data is compared with a threshold of a matrix corresponding to each pixel, and an ink dot setting is determined accordingly. Then, a threshold of the matrix is corrected so that, in a case where a space between ink dots formed by adjacent nozzles is larger than a predetermined value, a probability of ejection of an ink dot is increased, or a size of an ejected ink dot is increased. Such print image processing can be easily and effectively put to practical use.

According to a third aspect of the invention, a print image processing device, comprises: an ink dot setting controller that determines an ink dot setting for each pixel of image data by comparing a gradient of the each pixel with, from among thresholds in a matrix for each respective pixel, a threshold corresponding to the each pixel; and a threshold matrix correction unit that corrects a threshold of the matrix depending on ink output characteristics of each nozzle of a nozzle head of a printer device, the correction including, in a case that a space between ink dots formed by adjacent nozzles is smaller than a predetermined value, correcting the threshold so that a probability of an ink dot being formed for pixels corresponding to the adjacent nozzles is increased, or a size of an ink dot to be formed for the pixels is increased.

In the print image processing device according to the third aspect of the invention, a gradient of each pixel of image data is compared with a threshold of a matrix corresponding to each pixel, and an ink dot setting is determined accordingly. Then, a threshold of the matrix is corrected so that, in a case where a space between ink dots formed by adjacent nozzles is smaller than a predetermined value, a probability of ejection of an ink dot is decreased, or a size of an ejected ink dot is reduced. Such print image processing can be easily and effectively put to practical use.

BRIEF DESCRIPTION OF THE DRAWINGS

The invention will be described with reference to the accompanying drawings, where like numbers refer to like elements.

FIGS. 10A to 10C are diagrams for describing actions of the computation process shown in FIG. 9.

DESCRIPTION OF EXEMPLARY EMBODIMENTS

Description will now be given below of an embodiment of a printer device and print image processing device, with reference to the attached drawings.

Figure 1:
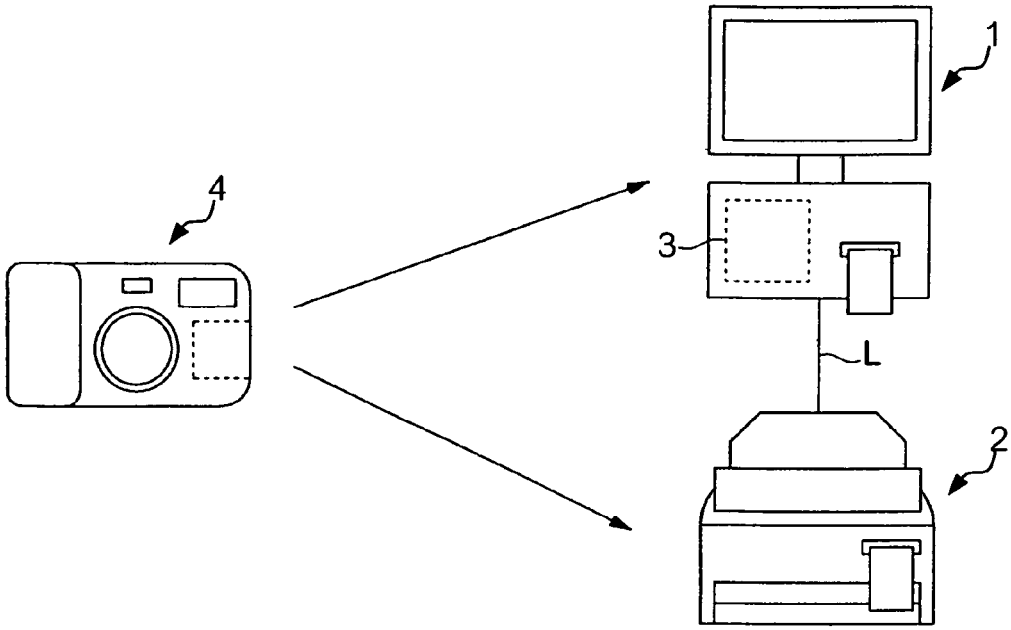
FIG. 1 is a diagram showing an example of a print system according to a first embodiment of a print image data processing device of the invention.

FIG. 1 shows an inkjet printer 2 of the present embodiment and a personal computer 1 which drives an inkjet printer 2. In the print system shown in FIG. 1, image data of, for example, a digital still camera 4 is read by personal computer 1 or inkjet printer 2; the image data is then printed by inkjet printer 2. A device driver 3 for driving inkjet printer 2 is loaded in personal computer 1. Device driver 3 is driven by application software, to thereby to drive inkjet printer 2, i.e., to cause inkjet printer 2 to perform a printing operation.

Figure 2:
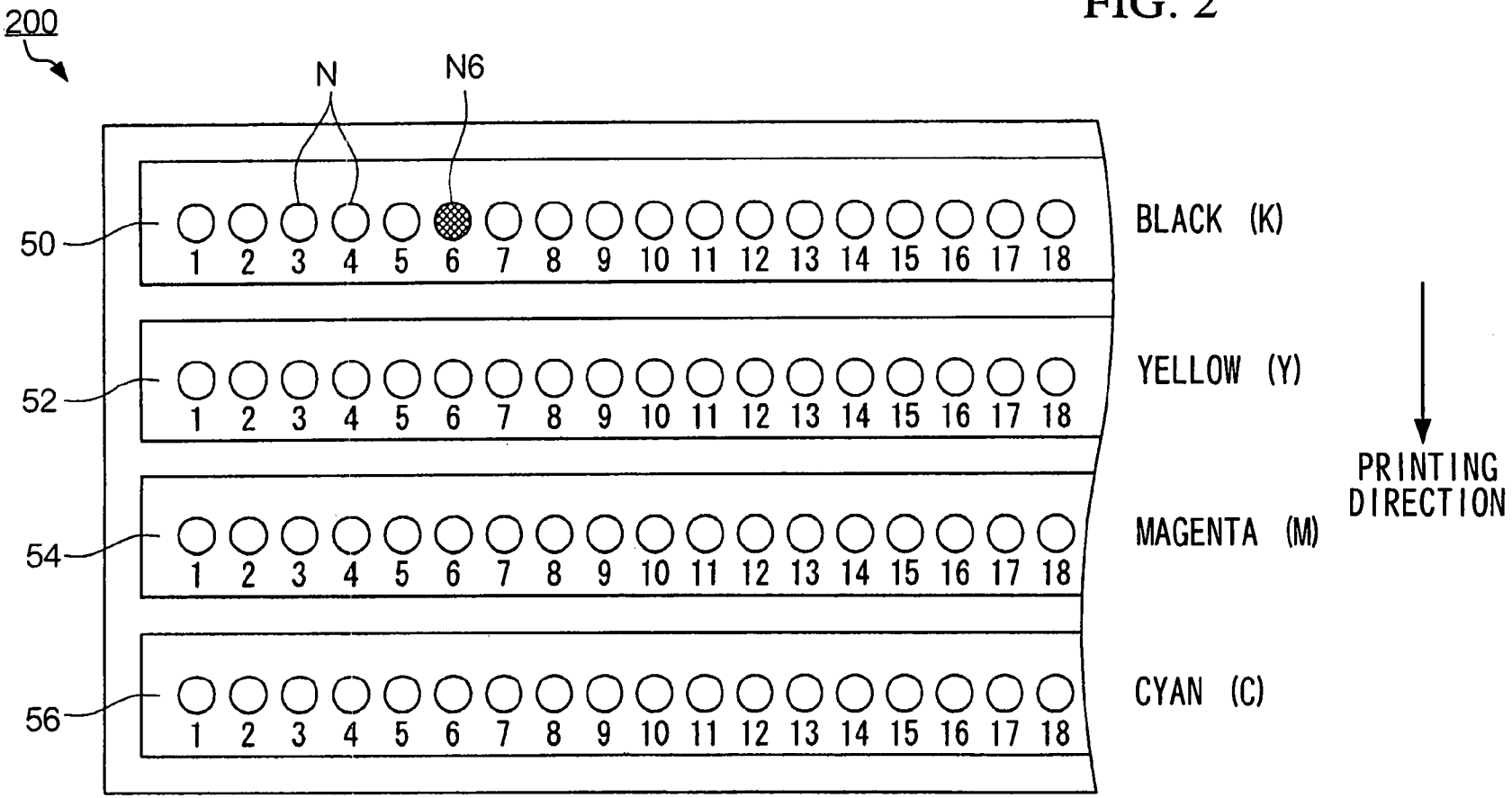
FIG. 2 is a diagram describing a nozzle head unit of an inkjet printer shown in FIG. 1.

Inkjet printer 2 according to the embodiment is a line head printer, as described above, and a nozzle head 200 of the printer 200 is configured, as shown in FIG. 2, to include a black nozzle array 50 where a plurality of nozzles Ns for ejecting Black (B) ink are lineally disposed; a Yellow nozzle array 52 where a plurality of nozzles Ns for ejecting Yellow (Y) ink are lineally disposed; a Magenta nozzle array 54 where a plurality of nozzles Ns for ejecting Magenta (M) ink are lineally disposed in series; and a Cyan nozzle array 56 where a plurality of nozzles Ns for ejecting Cyan (C) ink are lineally disposed, with the nozzle arrays being integrally formed in multiple rows.

Figure 3:
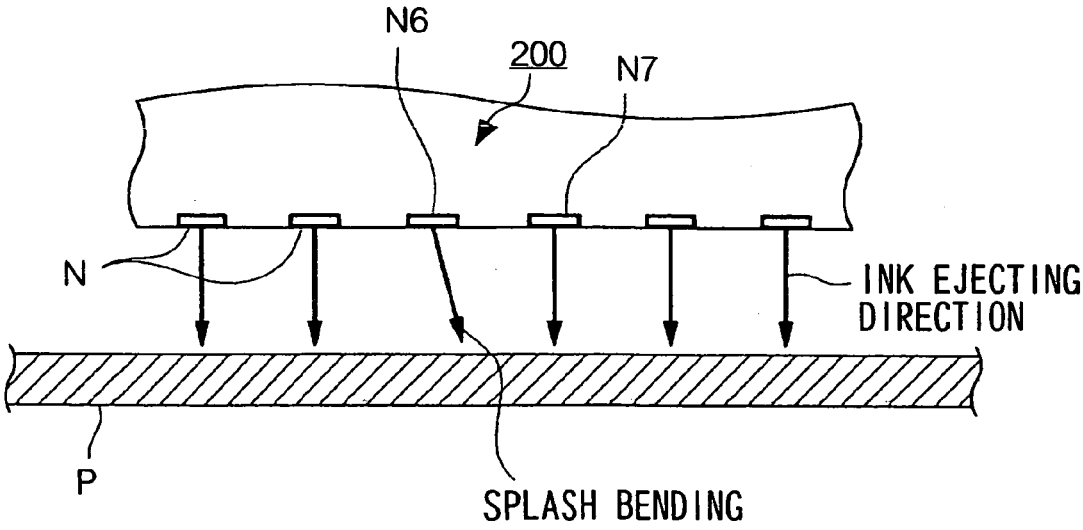
FIG. 3 is a diagram for explaining a splash bending of an ink ejected from a nozzle.

By this configuration, nozzle head 200 is able to print image data in a single pass by ejecting liquid ink from each nozzle of the head unit when an instruction signal is provided from the device driver causing a print medium to move in a print scanning direction with respect to the head unit. FIG. 3 shows an example of a splash bending phenomenon at Nozzle $N_6$, which occurs at a position 6th from the left of Black nozzle array 50. As shown, a direction of an ink droplet ejected from Nozzle $N_6$ deviates from a predetermined direction causing a dot to be formed close to that which is formed by an adjacent Nozzle $N_7$ on the print medium P.

Figure 4:
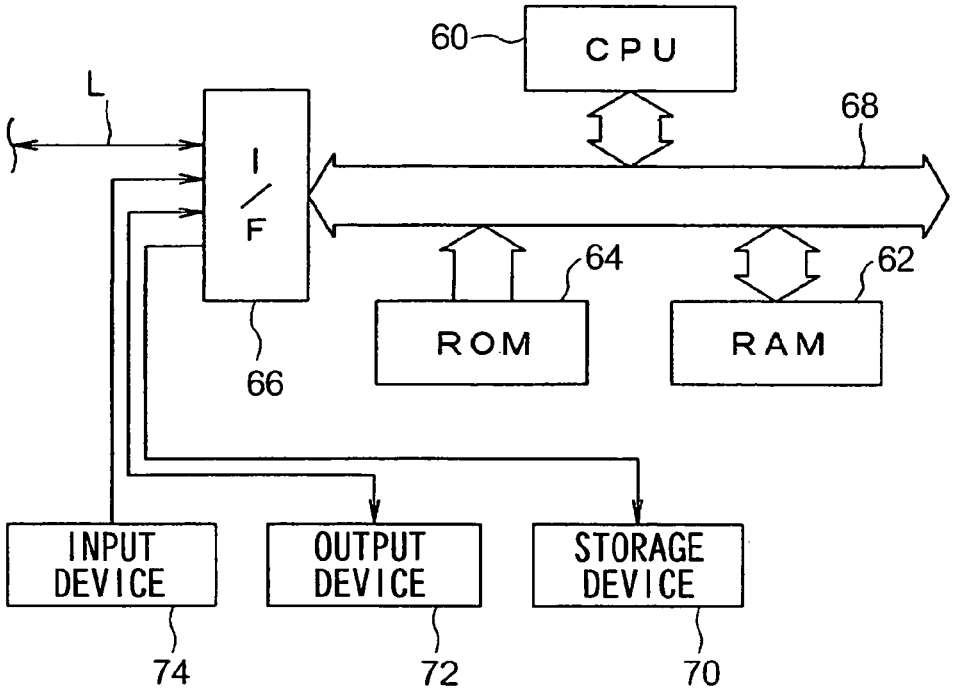
FIG. 4 is a diagram showing an example of an overview of a configuration of a personal computer shown in FIG. 1.

Device driver 3 is software. FIG. 4 shows a typical hardware configuration of personal computer 1 for causing device driver 3 and the application software to operate. As shown, there are provided, as a hardware configuration of personal computer 1, a CPU (Central Processing Unit) 60 which performs a variety of controls and computations, a RAM 62 which is a main storage device, a ROM 64 which is a read-only storage device, and various internal and external bus 68 such as a PCI bus and an ISA bus interconnecting CPU 60, RAM 62, and ROM 64. Provided further through an input/output interface (I/F) 66 connected to bus 68 are an external storage device 70 such as an HDD (Hard Disk Drive); an output device 72 such as inkjet printer 2, a CRT (Cathode Ray Tube), a LCD (Liquid Crystal Display) monitor, etc.; an input device 72 such as an operation panel, a mouse, a keyboard, a scanner, etc.; and a network L for communicating with a print instruction device (not shown).

When personal computer 1 is turned on, a system program such as BIOS stored in ROM 64 loads to RAM 62 various specific computer programs stored in advance in ROM 64, and other specific computer programs that have been installed in storage device 70 by way of a storage medium such as a CD-ROM, DVD-ROM, a flexible disk (FD) or through a communication network such as an Internet. CPU 60 executes predetermined control and computation processes using various resources according to instructions described in those programs loaded on RAM 62, to thereby realize following software functions. The application software for driving device driver 3 may be provided in a printer control unit provided in an inkjet printer, or in an independent computer system. Similarly, the application software for driving the device driver may be executed in the printer control unit provided in an inkjet printer, or in an independent computer system. It is also possible to use hardware for realizing the same functions as the device driver and application software.

Figure 5:
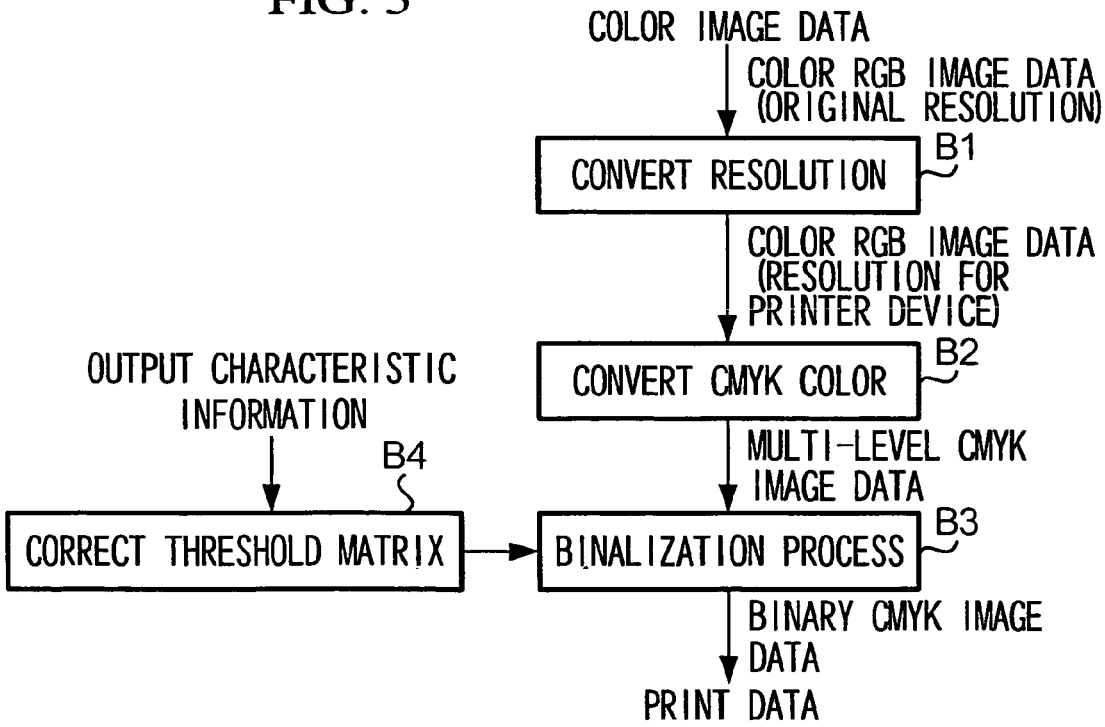
FIG. 5 is a functional block diagram of a device driver provided in the personal computer shown in FIG. 1.

As described above, the device driver of the present embodiment is software. Description will be next given of a procedure of the computation process of the device driver. FIG. 5 is a functional block diagram of the device driver. In a resolution conversion block $B_1$, color image data is first converted to a resolution that is suitable for a printer device. For example, when an input image data is a multi-level color RGB image data whose gradient (a value of brightness) for each color (R, G, B) is expressed using 8 bits (0-255), the image data is converted into a color RGB image data having a resolution that is suitable for a printer device which is to be used for printing the subject image data. Next, in a CMYK color conversion block $B_2$, the color RGB image data that has been converted into the resolution for the printer device is then converted into data of the four colors, namely, CMYK, and a multi-level CMYK image data is generated whose tone is also expressed using 8 bits.

In the binarization processing block $B_3$, the multi-level CMYK image data is then binalized for each pixel. The binalization process targets on one of the pixels constituting an image data, and to decide whether to eject or not to eject liquid ink from a nozzle with respect to the target pixel. For example, if the target pixel can be expressed using 8 bits (256 tones or gradients), and its gradient is "101", it is determined in a normal binalization process that the target pixel has a binary value of "0", which means that the pixel is determined to not require ink dot formation since a tone level is below a threshold (a median value) that is "127." As a result, "101" is discarded. Thus, if such a binalization process for deciding whether to form dot is executed for every pixel, halftones existing in the original image data are simply ignored.

For this reason, the present embodiment employs, for example, a dither matrix method for expressing halftones. In a case of using white and black, the dither matrix method can express different tones of "gray" using only white and black since this method provides a technique for expressing a variety of tones using predetermined tones. In other words, white and black are generated according to predetermined rules and based on the tones of the original image data, which in the present embodiment are the tones of a multi-level CMYK image data, whereby halftones can be expressed by a ratio of black and white. Since halftones cannot be properly expressed if a read signal is merely binalized according to a fixed threshold, the displayed levels of gradation for halftones are determined by comparing a read density of each pixel with a threshold computed according to a certain rule. A threshold can also be determined on the basis of a density of neighboring pixels.

Figure 6:
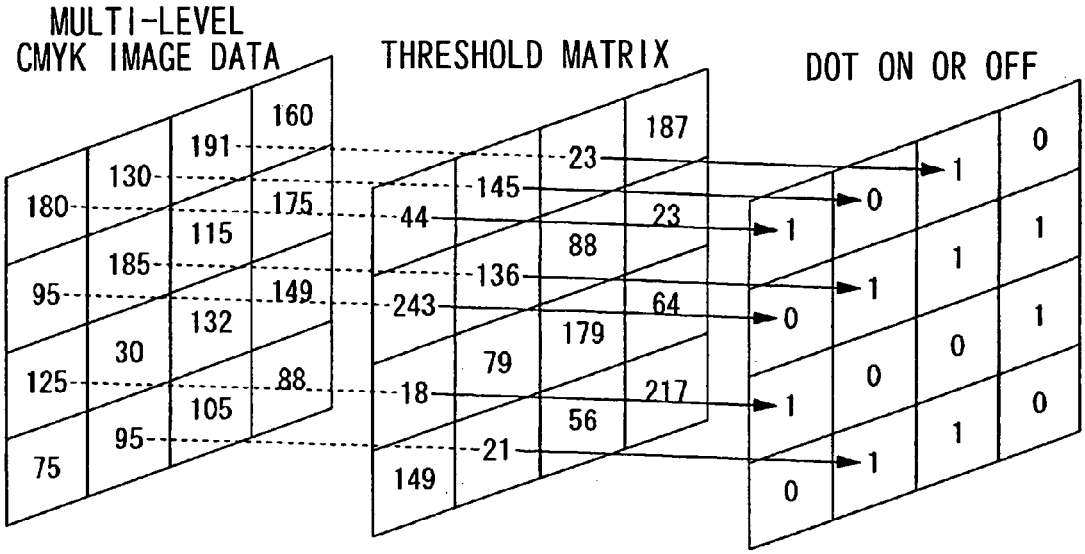
FIG. 6 is a schematic diagram showing ink dot settings according to a dither matrix method.

FIG. 6 illustrates a concept of a binalization using a Bayer-type threshold matrix. For example, when a pixel at the left top is numbered as 0 and pixels to the right of the pixel 0 are sequentially numbered as 1, 2, . . . , the pixel having Number 0 in the top row (line) of the multi-level CMYK data has a gradation level of "180" while that of the threshold matrix has a value of "44". These values are compared, and an ink dot is accordingly formed for the corresponding pixel, i.e., a logical value "1" is obtained. The next right pixel having Number 1 has a gradation level of "130", but the threshold provided for a corresponding pixel of the matrix is "145". Therefore, no ink dot is formed for the corresponding pixel, i.e., a logical value of "0" is obtained. Thus, by appropriately setting thresholds of a matrix, halftones can be finely expressed.

Description will now be given referring again to FIG. 5. In the present embodiment, in a threshold matrix correction block $B_4$, the thresholds of the dither matrix are corrected depending on output characteristic information of data of a reference print operation, i.e., an ink output characteristic of each nozzle of the line head. In the present embodiment, a determined quantity of splash bending is used as a basis for determining an ink output characteristic of each nozzle of the line head; and each threshold of the matrix is corrected on the basis of the determined quantity the splash bending. Detailed description of the correction process will now be given below.

Figure 7:
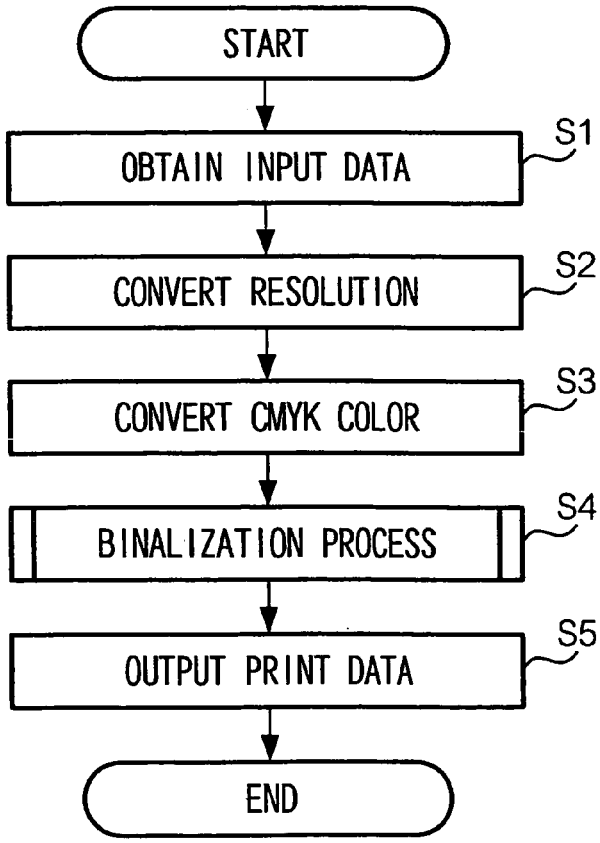
FIG. 7 is a flow chart showing a computation process executed for realizing the functional blocks shown in FIG. 5.

FIG. 7 is a flowchart showing a computation process for realizing functional blocks shown in FIG. 5. In Step S1 of the computation process, image data is obtained from the application software as an input image, i.e., a color RGB image data. In Step S2, the color RGB image data is converted into data having a resolution suitable for a printer device. In Step S3, the data is further converted into multi-level CMYK image data. Further in Step S4, the binalization process is performed according to the computation process described below, and shown in FIG. 8. In Step S5, print data is output to inkjet printer 2.

Figure 8:
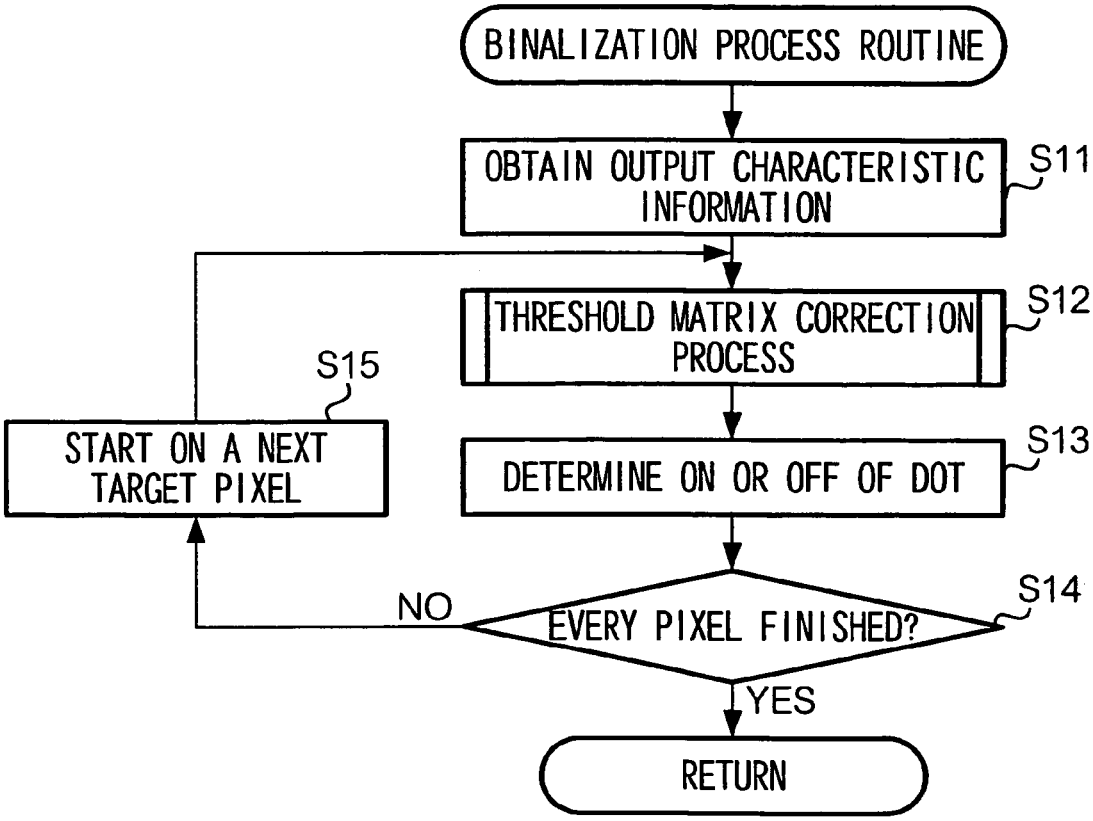
FIG. 8 is a flowchart showing a sub routine executed as a part of the computation process shown in FIG. 7.

Description will be next given of the computation process shown in FIG. 8 corresponding to Step S4 of the computation process of FIG. 7. Inkjet printer 2 stores in advance a table data containing information on a quantity of splash bending of each nozzle or data of a function used for outputting a quantity of splash bending of each nozzle. Such information or function is generated, for example, by printing a predetermined test pattern, and measuring a position of a dot formed in the printed test pattern. In Step S11, personal computer 1 obtains from inkjet printer 2 the table data or the function data for use in the computer to obtain a quantity of splash bending of each nozzle, with such a quantity being used to determine a deviation from an ideal ink dot forming position (or an ideal landing position). Alternatively, personal computer 1 may obtain the table data or the function data, prior to the process of FIG. 7, such as at a time of installing device driver 3. Further alternatively, personal computer 1 may request inkjet printer 2 to obtain a quantity of splash bending for each nozzle from the table or based on the function, and to provide an obtained result to personal computer 1. In the present embodiment, the quantity of the splash bending is referred to as FC, and the FC is given a positive value when the bending has occurred to a right direction with respect to the ideal landing position, and a negative value when the bending is to a left direction. In Step S12, the threshold matrix is corrected according to a computation process shown in FIG. 9, which will be described below. In Step S13, it is determined whether to form an ink dot on a target pixel, i.e, to determine ON or OFF of each pixel, on the basis of the threshold matrix corrected in Step S12 and the multi-level CMYK image data converted in Step S3 in the computation process of FIG. 7. In Step S14, it is determined whether the determination to decide ON or OFF is completed for all pixels of the matrix, and when it is Yes, the routine proceeds to Step S5 of the computation process of FIG. 7; and when it is No, the routine proceeds to Step S15. In Step S15, a next target pixel is identified and the processes in and after Step S12 are performed for the newly identified target pixel.

Figure 9:
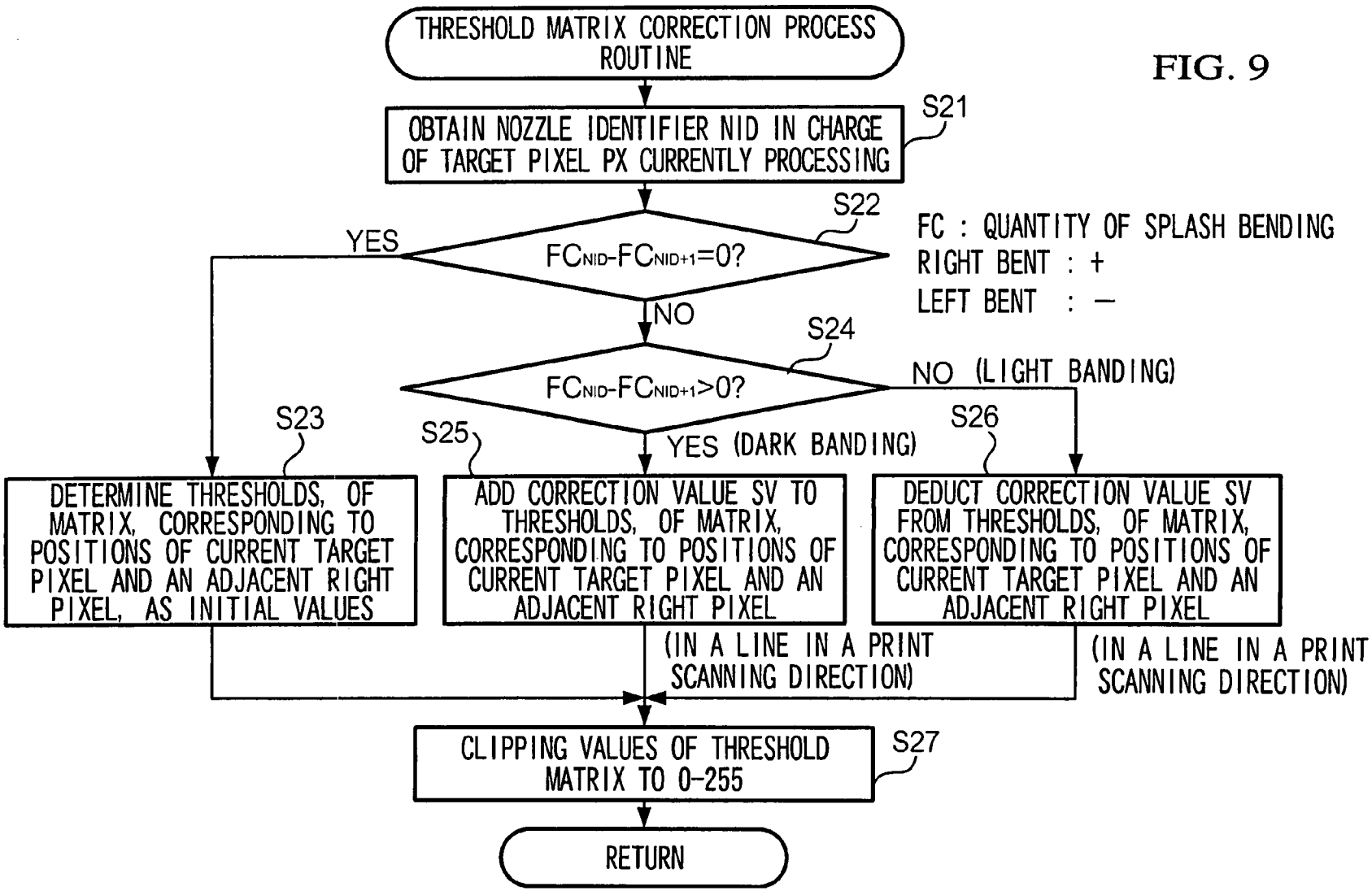
FIG. 9 is a flowchart showing a sub routine executed as a part of the computation process shown in FIG. 8.

Description will be next given of the computation process shown in FIG. 9, which corresponds to Step S12 of the computation process of FIG. 8. In the computation process shown in FIG. 9, in Step S21, a nozzle identifier NID is obtained of a nozzle for a target pixel PX that is presently being processed, i.e., a nozzle which is used to form an ink dot to a position corresponding to the target pixel. In Step S22, it is determined whether $FC_{NID}-F_{NID+1}=0$ is true, where $FC_{IND}$ is the quantity of splash bending of a nozzle identified by the nozzle identifier NID obtained in Step S21 and $FC_{NID+1}$ is that of a nozzle adjacent right to the nozzle NID. Here, $FC_{NID}$ and $FC_{NID+1}$ are obtained from among ink output characteristics, i.e., the quantities of splash bending FCs obtained in Step S11 of the computation process of FIG. 8. When it is determined that the deducted value $FC_{NID}-FC_{NID+1}$ is equal to 0, the routine proceeds to Step S23; and when it is not, the routine proceeds to Step S24.

In Step S24, it is determined whether the deducted value $FC_{NID}-FC_{NID+1}$ is greater or smaller than 0, given that it is determined that the deducted value $FC_{NID}-FC_{NID+1}$ is not 0 in Step S22. When the deducted value $FC_{NID}-FC_{NID+1}$ is larger than 0, the routine proceeds to Step S25, and if smaller, the routine proceeds to Step S26. The routine proceeds to Step S27 after performing the following process in one of Steps S23, S25, and S27 depending on determinations in Steps S22 and S24: a) Step S23: the current values of thresholds, of the threshold matrix, corresponding to the locations of the target pixel and its adjacent right pixel are determined to be maintained. Here, these thresholds are determined according to the dither matrix method; b) Step S25: a predetermined value of correction SV (30 in the present embodiment) is added to each of the current values of thresholds, of the threshold matrix, corresponding to the locations of the target pixel and its right-hand adjacent pixel; and c) Step S26: a predetermined value of correction SV (30 in the present embodiment) is deducted from each of the current values of thresholds, of the threshold matrix, corresponding to the locations of the target pixel and the pixel adjacent right to the target pixel. In Step 27, values of the threshold matrix (thresholds) obtained in Steps S25, S26, and S27 are clipped (truncated) to levels of gradation 0-255 expressed using 8 bits, and the routine then proceeds to Step S13 of FIG. 8.

According to the computation process described above, a predetermined value of correction SV (=30) is deducted from each of the current values of thresholds, of the threshold matrix, corresponding to the locations of the target pixel and the pixel next right to the target pixel when it is found that the deducted value $FC_{NID}-FC_{NID+1}$ is smaller than 0, which is a predetermined value; $FC_{NID}$ being a quantity of splash bending of a nozzle identified by a nozzle identifier NID corresponding to the current target pixel and $FC_{NID+1}$ being that of a nozzle identified by a nozzle identifier NID+1 that is next right to the nozzle NID. Given that, in the present embodiment, the quantity of the splash bending FC shows a positive value when the bending direction is right, and a negative value when the bending direction is left, we can infer from the deducted value $FC_{NID}-FC_{NID+1}$ being smaller than 0 that at least one of the following cases has occurred: a) a quantity of splash bending of Nozzle NID is a negative value, i.e., the ejecting direction of the nozzle deviates to the left; and b) the quantity of splash bending of Nozzle NID+1 is a positive value, i.e., the ejecting direction of the nozzle deviates to the right. This means that a space is large between ink dots ejected from nozzles next to each other. When spaces between adjacent ink dots become large, light banding is likely to occur. By deducting the correction amount SV from the thresholds of identified locations of the dither matrix, a probability of an ink dot being formed at the subject locations of the pixel is increased, or a larger ink dot is formed. As a result, instances of banding, and in particular light banding can be effectively minimized.

On the other hand, a predetermined value of correction SV (=30) is added to each of the current values of thresholds, of the threshold matrix, corresponding to the locations of the target pixel and the pixel next right to the target pixel when it is found that the deducted value $FC_{NID}-FC_{NID+1}$ is larger than 0 which is a predetermined value, the $FC_{NID}$ being a quantity of the splash bending of a nozzle identified by a nozzle identifier NID corresponding to the current target pixel and $FC_{NID+1}$ being that of a nozzle identified by a nozzle identifier NID+1 that is next right to the nozzle NID. Given that, in the present embodiment, the quantity of the splash bending FC is a positive value when the bending direction is right, and a negative value when the bending direction is left, we can infer from the deducted value $FC_{NID}-FC_{NID+1}$ being larger than 0 that at least one of the following cases has occurred: a) the quantity of the splash bending of Nozzle NID is a positive value, i.e., the ejecting direction of the nozzle deviates to the right; and b) the quantity of the splash bending of Nozzle NID+1 is a negative value, i.e., the ejecting direction of the nozzle deviates to the left. This means that a space is small between ink dots ejected from nozzles next to each other. When spaces between adjacent ink dots become small, a dark band is likely to appear. By adding the correction amount SV to the thresholds of certain locations of the dither matrix, the probability of an ink dot being formed is decreased at the subject locations of the pixel, or a size of an ink dot to be formed is decreased. As a result, instances of banding, in particular, dark banding, are effectively minimized.

FIGS. 10A-10C show diagrams for describing actions of the present embodiment. FIG. 10A shows a dither matrix having initial values of a threshold matrix determined according to the dither matrix method. When a "light band" appears between pixels of the second and the third columns, the correction value SV (=30) is deducted from each threshold of the matrix corresponding pixels as shown in FIG. 10B, where the figure showing values clipped according to 0-255. As the thresholds become smaller, there is a larger possibility of an ink dot being formed or a formed ink dot becomes larger; as a result, a light band becomes less visible. On the other hand, when a "dark band" appears between pixels of the second and the third columns, the correction value SV (=30) is added to each threshold of the matrix corresponding pixels as shown in FIG. 10C, where the figure showing values clipped according to 0-255. As the thresholds become larger, there is a smaller possibility of an ink dot being formed or a formed ink dot becomes smaller; as a result, a dark band becomes less visible. It is to be noted that, as is apparent from the figure, in the line head inkjet printer such as of the present embodiment, a light banding or dark banding appears constantly on the same portions, i.e., lines. Therefore, upon detecting a line where a correction is needed, the thresholds of the both sides of the line may be corrected along the line in the print scanning direction.

As in the foregoing, according to a printer device and a print data processing device of the present embodiment, ink dot setting is controlled by comparing levels of gradation for each pixel of image data with thresholds of a matrix corresponding to each pixel of the image data. In controlling ink ejected from each nozzle of a head based on the ink dot settings, predetermined thresholds of the matrix are modified depending on an ink output characteristic of each nozzle of the head, for example, relative to data of a reference print operation. In a case that a space between ink dots formed by adjacent nozzles is larger than a predetermined value, a threshold of the matrix is modified so that a probability of an ink dot being formed is increased, or a size of the formed ink dot is increased. On the other hand, when a space between adjacent ink dots is smaller than a predetermined value, a threshold of the matrix is modified so that a probability of an ink dot being formed is decreased, or a size of a formed ink dot is decreased. In this way, banding can be readily and effectively reduced, and the devices of the invention can be put to commercial use.

According to the present embodiment, a light banding, in particular, of the banding phenomenon can easily be reduced since, in a case that a space between ink dots formed by adjacent nozzles is larger than a predetermined value, a threshold of the matrix is modified so that a possibility of an ink dot being formed becomes larger or a size of the formed ink dot becomes larger.

On the other hand, a dark banding, in particular, of the banding phenomenon can easily be reduced since, when a space between adjacent ink dots is smaller than a predetermined value, a threshold of the matrix is modified so that the ink dot is less likely to be formed and a size of the ink dot becomes smaller.

Further, light and dark banding can be readily and effectively reduced since a space between ink dots formed by adjacent nozzles is determined based on a quantity of splash bending.

In the above embodiment, the correction value SV applied to a threshold of the matrix is 30, for both dark banding and light banding, but is not limited thereto. The correction amount may have different values for each of dark and light banding, or may vary depending, for example, on a quantity of splash bending. Alternatively, a correction amount may be set depending on a state of inconsistencies in density in data obtained through an actual print operation.

Further, in the above embodiment, thresholds of the matrix are modified by comparing a quantity of splash bending of a nozzle for a current target pixel with that of a nozzle next right to the nozzle for the target pixel. However, such comparison can also be made relative to adjacent nozzles on both sides of a nozzle for a current target pixel.

Further, in the above embodiment, it is determined whether to and how to modify thresholds of the matrix depending on a case where a) a deducted value $FC_{NID}-FC_{NID+1}$ corresponds to 0, b) the deducted value is larger than 0, and c) the deducted value is smaller than 0. However, such determination is not limited to use of a value of 0. For example, an ignored range or zone can be set even in a case that either more or less splash bending is observed, with the preset ignored range defining a certain degree of banding that is unlikely to be noticeable. In this case, matrix thresholds are modified only where a quantity of splash bending exceeds that of the preset ignored zone. Further, correction amounts of the thresholds of the matrix may be set depending on a size of the preset ignored zone.

Further, according to the above embodiment, a dither matrix method is used for determining an ink dot setting. However, the printer device and the print image processing device of the invention are not limited thereto but may be applied to any type of technique which employs a threshold matrix corresponding to pixels in determining ink dot settings.

Further, in the above embodiment, thresholds of a threshold matrix are repeatedly modified. However, since in a line head printer, all dots under one column are formed using a single nozzle, a modified threshold matrix can be generated before binalization so that the matrix covers an entire width of the image (i.e., a print head width), whereby binalization can be performed using the single modified threshold matrix.

Further, in the above embodiment, while description is given of a case where the printer device and the print data processing device of the invention are applied to line head printers. However, the printer device and the print data processing device of the invention may be also applied to other types of inkjet printers, such as multi-pass printers.

Figure 11A:
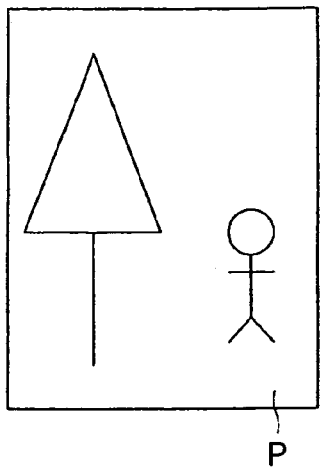
FIGS. 11A to 11C are diagrams showing differences of printing systems between a multi-pass printer and a line head printer.
Figure 11B:
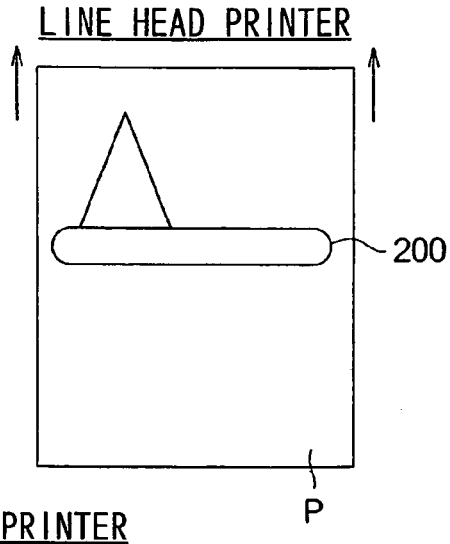
Figure 11C:
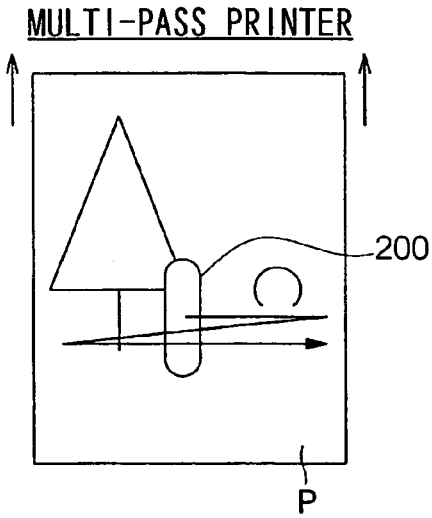

FIGS. 11A to 11C show printing systems for a line head inkjet printer and a multi-pass inkjet printer. In the line head inkjet printer, as shown in FIG. 11B, print head 200 has a width corresponding to a width of the print paper P. Print head 200 is fixed in position, and the print paper P is moved in a direction orthogonal to a longitudinal direction of line head 200, whereby printing is completed in a single pass. It is to be noted that the print paper P may be fixed such as in a so-called flat bed scanner, with print head 200 being moved in the direction orthogonal to the longitudinal direction of line head 200. Further, alternatively, printing may be performed by moving the print paper P and print head 200 in directions that are reverse relative to each other.

On the other hand, as shown in FIG. 11C, in the multi-pass inkjet printer, there is provided print head 200 having a width that is considerably shorter than the paper width. Print head 200 is caused to reciprocate many times in a direction orthogonal to a longitudinal direction of print head 200, while the print paper is moved by a predetermined pitch in a direction same as the longitudinal direction of print head 200. Thus, while the multi-pass inkjet printer suffers from a disadvantage of a longer print time when compared with a line head inkjet printer, light banding, in particular, can be reduced since print head 200 can be repeatedly positioned at a given location.

Figure 12:
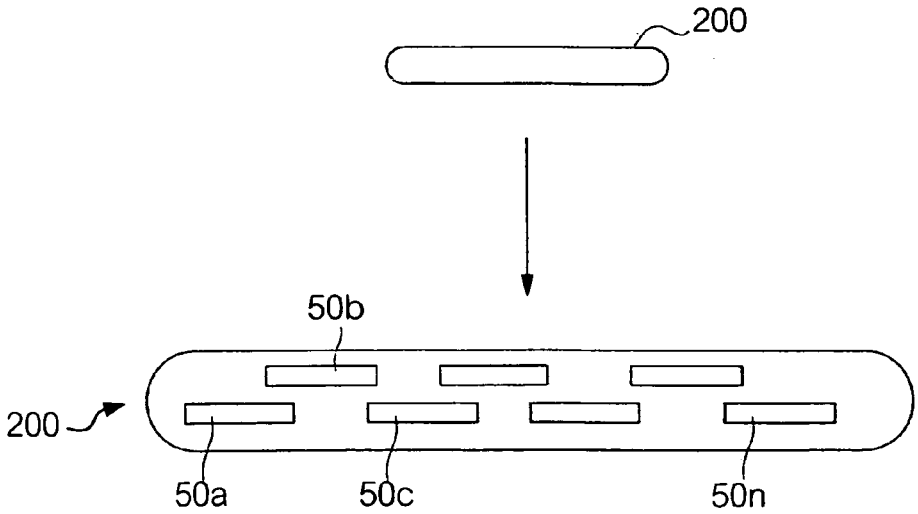
FIG. 12 is a schematic diagram showing another example of a configuration of a print head.

In FIG. 3, there are shown each nozzle array 50, 52, 54, and 56, for each color provided in print head 200, in which nozzle array nozzles Ns are lineally disposed in a longitudinal direction of print head 200. Alternatively, as shown in FIG. 12, each nozzle array 50, 52, 54, and 56 may be short nozzle units 50*a*, 50*b*, . . . 50*n*. These short nozzle units may be staggered with respect to a direction of movement of print head 200. With this configuration, high-resolution image printing can be readily realized since distances (pitches) between dots can be effectively made shorter, without the need to shorten actual distances between dots formed by each nozzle unit 50*a*, 50*b*, . . . 50*n*.

What is claimed is:

1. A printing device, comprising:

a memory that stores a matrix including thresholds for each of respective pixels, the threshold corresponding to each pixel of image data, the memory being further configured to store a correction value;

a print head having a plurality of nozzles capable of ejecting ink on a print medium and of forming one or more types of ink dots on the print medium;

an ink dot setting unit that determines an ink dot setting for each pixel of image data by comparing a gradation of the each pixel with, from among the thresholds in the matrix stored in the memory, a threshold corresponding to the each pixel of image data;

a print head controller that controls ejection of ink from each nozzle of the print head on the basis of an ink dot setting determined by the ink dot setting controller; and a threshold matrix correction unit that executes adding or subtracting the correction value to or from the threshold of the matrix stored in the memory, in response to ink output characteristics of each nozzle of the print head, the adding or subtracting the correction value being executed for pixels that are determined to have splash bending, wherein the threshold matrix correction unit, in a case that an amount of space between ink dots formed by adjacent nozzles is larger than the predetermined value, is configured to subtract the correction value from a threshold in the matrix such that a probability of an ink dot being formed for the subject pixel is increased, or a size of an ink dot formed for the subject pixel is increased, and after adding or subtracting the correction value, the threshold matrix before adding or subtracting the correction value is deleted from the memory.

2. A printer device, according to claim 1, wherein the threshold matrix correction unit, in a case that an amount of space between ink dots formed by adjacent nozzles is smaller than the predetermined value, is configured to add the correction value to a threshold in the matrix such that a probability of an ink dot being formed for the subject pixel is decreased, or a size of an ink dot to be formed for the subject pixel is decreased.

3. A printer device according to claim 2, wherein the threshold matrix correction unit uses, as the ink output characteristic, a quantity of splash bending showing an amount of deviation from an ideal ink dot position from each nozzle of the head, to determine the amount of space between ink dots formed by the adjacent nozzles based on the quantity of splash bending.

4. A print image processing device, comprising:

a memory that stores a matrix including thresholds for each of respective pixels, the threshold corresponding to each pixel of image data, the memory being further configured to store a correction value;

an ink dot setting controller that determines an ink dot setting for the each pixel of image data by comparing a gradation of the each pixel, from among the thresholds in the matrix stored in the memory, with a threshold corresponding to each pixel; and a threshold matrix correction unit that executes adding or subtracting the correction value to or from a threshold of the matrix stored in the memory, in response to ink output characteristics of each nozzle of a nozzle head of a printer device, the adding or subtracting the correction value is executed for pixels that are determined to have splash bending, the correction including, in a case that a space between ink dots formed by adjacent nozzles is larger than a predetermined value, subtracting the correction value from the threshold so that a probability of an ink dot being formed for pixels corresponding to the adjacent nozzles is increased, or a size of an ink dot to be formed for the pixels is increased, and after adding or subtracting the correction value, the threshold matrix before adding or subtracting the correction value is deleted from the memory.

5. A print image processing device according to claim 4, wherein:

the threshold matrix correction unit is configured to correct the threshold of the matrix in response to ink output characteristics of each nozzle of the nozzle head of the printer device, the correction including, in a case that the space between ink dots formed by adjacent nozzles is smaller than the predetermined value, adding the correction value to the threshold so that a probability of an ink dot being formed for pixels corresponding to the adjacent nozzles is increased, or a size of an ink dot to be formed for the pixels is decreased.

* * * * *